US007950553B2

(12) United States Patent
Rassias

(10) Patent No.: US 7,950,553 B2
(45) Date of Patent: May 31, 2011

(54) AUTOMATICALLY LOCKING HIGH SECURITY HOLSTER

(76) Inventor: John N. Rassias, Boca Raton, FL (US)

( * ) Notice: Subject to any disclaimer, the term of this patent is extended or adjusted under 35 U.S.C. 154(b) by 584 days.

(21) Appl. No.: 11/913,370

(22) PCT Filed: May 8, 2006

(86) PCT No.: PCT/US2006/017608

§ 371 (c)(1),
(2), (4) Date: May 28, 2008

(87) PCT Pub. No.: WO2006/121965

PCT Pub. Date: Nov. 16, 2006

(65) Prior Publication Data

US 2009/0114693 A1 May 7, 2009

Related U.S. Application Data

(60) Provisional application No. 60/678,504, filed on May 6, 2005.

(51) Int. Cl.
*F41C 33/02* (2006.01)

(52) U.S. Cl. ..... 224/243; 224/912

(58) Field of Classification Search ..... 224/192, 224/193, 198, 238, 243, 244, 911, 912, 197, 224/200, 914; *F41C 33/02*
See application file for complete search history.

(56) References Cited

U.S. PATENT DOCUMENTS

| | | | | |
|---|---|---|---|---|
| 3,269,620 | A | 8/1966 | DuBois | |
| 3,550,822 | A | 12/1970 | Lloyd | |
| 3,744,687 | A | 7/1973 | Oreck | |
| 4,055,015 | A | 10/1977 | Musgrave | |
| 4,325,505 | A | 4/1982 | Hillman | |
| 4,689,908 | A | 9/1987 | McClellan | |
| 4,858,799 | A | 8/1989 | Young | |
| 4,901,987 | A | 2/1990 | Greenhill et al. | |
| 4,912,867 | A | 4/1990 | Dukes, Jr. | |
| 5,094,376 | A | 3/1992 | Baruch | |
| 5,099,596 | A | 3/1992 | Butler, Jr. | |
| 5,215,238 | A | 6/1993 | Baruch | |
| 5,419,069 | A | 5/1995 | Mumbleau et al. | |
| 5,446,988 | A | 9/1995 | Frederick, Jr. | |
| 5,467,909 | A | 11/1995 | Resca et al. | |
| 5,551,611 | A * | 9/1996 | Gilmore | 224/198 |

(Continued)

FOREIGN PATENT DOCUMENTS

| | | |
|---|---|---|
| DE | 19952640 | 6/2000 |

(Continued)

*Primary Examiner* — Justin M Larson
(74) *Attorney, Agent, or Firm* — The Webb Law Firm

(57) ABSTRACT

A holster for securing a pistol having a barrel with a chamber, a muzzle, a slide having a front and rear portion, includes (a) an open-bottom enclosure sized to accommodate the slide, wherein a cavity defined in a front portion of the enclosure is sized to receive the muzzle but not allow the slide to enter therein; (b) a securing member pivotally attached within the enclosure near a rear portion thereof and shaped to correspondingly mate with a rear portion of the slide; (c) a lever disposed externally to the enclosure and attached via a connecting member to the securing member; (d) a spring disposed between an interior surface of the enclosure and the securing member; and (e) a protuberance extending from the interior surface of the enclosure and sized to be received into the chamber when the pistol is secured within the enclosure.

24 Claims, 20 Drawing Sheets

U.S. PATENT DOCUMENTS

| | | | | |
|---|---|---|---|---|
| 5,611,164 | A | 3/1997 | Rassias | |
| 5,768,816 | A | 6/1998 | Rassias | |
| 5,875,944 | A | 3/1999 | Beletsky | |
| 6,149,042 | A | 11/2000 | Rassias | |
| 6,267,279 | B1 | 7/2001 | Matthews | |
| 6,415,541 | B1 | 7/2002 | Rassias | |
| 6,585,209 | B1 | 7/2003 | Mattingly | |
| 6,691,906 | B2 | 2/2004 | Cragg | |
| 6,732,891 | B2 | 5/2004 | Locklear, III | |
| 6,755,331 | B2 | 6/2004 | Rassias | |
| 7,591,402 | B2 * | 9/2009 | Rassias | 224/243 |
| 7,850,053 | B2 * | 12/2010 | Rassias | 224/243 |
| 2001/0048009 | A1 | 12/2001 | Vor Keller et al. | |
| 2003/0205594 | A1 | 11/2003 | Rassias | |
| 2005/0035163 | A1 | 2/2005 | French et al. | |
| 2005/0224537 | A1 | 10/2005 | Rassias | |
| 2007/0163164 | A1 * | 7/2007 | Avrahami et al. | 42/87 |
| 2008/0093400 | A1 * | 4/2008 | Stevens | 224/243 |

FOREIGN PATENT DOCUMENTS

| | | |
|---|---|---|
| DE | 10154226 | 5/2003 |
| WO | 9745691 | 12/1997 |
| WO | 2005033610 | 4/2005 |

* cited by examiner

AUTOMATICALLY LOCKING HIGH SECURITY HOLSTER

CROSS REFERENCE TO RELATED APPLICATIONS

This application claims the benefit of U.S. Provisional Patent Application No. 60/678,504, filed May 6, 2005, entitled "Automatically Locking High Security Holster," the contents of which are incorporated herein by reference.

BACKGROUND OF THE INVENTION

1. Field of the Invention

The present invention relates to a high security holster with a locking mechanism and methods of use thereof.

2. Description of Related Art

Over the past several years, law enforcement personnel have been targeted by highly aggressive members of the citizenry throughout the day-to-day duties of law enforcement personnel. The media broadcasts weekly violent attacks on law enforcement officers, which oftentimes ends in severe wounding or deaths of the officers and innocent bystanders. The term "gun grab" has become widely understood. For example, the unfortunate events of a successful gun grab in the year 2005 from an officer in a municipal courthouse in Atlanta, Ga. ended in the untimely death of law enforcement personnel and a judge. Another gun grab attempt in a Rhode Island police headquarters resulted in the death of a police detective with his own pistol in the hands of a suspect during questioning.

Unfortunately, the safety features of conventional prior art holster designs have become marginalized by their own descriptive terminology. For prior art holsters, the levels of pistol retention in the holster are rated on a scale of Levels 1 through 4 depending upon the degree of safety features provided with a holster. A conventional holster with a simple strap means that the holster has a Level 1 retention rating. A holster with a rotating thumb brake cover on a strap means that the holster has a Level 2 retention rating. A holster with a ring finger disengagement snap or depression release means that the holster has a Level 3 retention rating. Tensioning screws are employed to reach a professed higher level of retention; however, they need constant adjustment on a daily basis as their tension is subject to temperature variations. They are more of a marketing tool than a dependable element of protection.

Rating conventional holsters with levels of retention ratings is dangerous to law enforcement personnel and is misguided. A sequence of complex maneuvers must occur during the performance of actions needed to engage safety retention levels of a pistol in the holster and also to disengage safety retention levels to access a pistol in the holster. Each level of retention restricts access to the pistol when needed by a law enforcement officer. Any out-of-sequence maneuver could prolong the time to access the pistol or even render the pistol inaccessible for self-defense. Proponents of the levels of retention ratings erroneously believe that, in a gun grab attempt, an officer will be able to protect himself from violent physical action by a perpetrator as the officer tries to protect himself and maintain security over his gun. An individual attempting a gun grab to disarm an officer of his or her weapon has not only the belief that he will be successful in the attempt, but also intends to cause serious harm or death to the officer. During a gun grab attempt, an officer is obligated by the protocols of his duty to resist harming his attacker under the law enforcement departmental guidelines expressed in force continuum principles, which are certainly not a consideration, nor a restraint to a perpetrator. During the physical confrontation with his opponent, the officer must protect his pistol first, with at least one hand, if not two hands; attempt to ward off his attacker; and at the same time, attempt to draw his pistol in a complicated sequence of complex motor memory actions. Under stress, complex motor memory fails to yield the desired result.

In order to overcome the problems associated with prior art holsters, there is a need to provide a security holster with a locking lever that works synergistically with the dimensions and mechanics of a slide action pistol for safe and secure holstering of a pistol and for quick drawing of the loaded pistol from the holster.

SUMMARY OF THE INVENTION

Accordingly, the present invention provides an automatic self-locking high security holster with a locking system. The security holster and locking system allows an officer to defend against dangerous aggression through assurance that the locking system of the holster is extremely difficult to override by a perpetrator attempting a gun grab and by the reverse maneuver needed to draw the pistol. The design of the automatic self-locking, high security holster with the locking system will help to thwart gun grab attempts so that the law enforcement officers can be protected against the overt aggression of the criminal element. The safety features provided by the security holster with a locking system provide a paradigm shift in both on-duty and off-duty pistol retention within the control of the law enforcement officer. The safety features also provide a significant increase in pistol drawing speed and added pistol security through use of only one hand in a gross motor movement.

The security holster of the present invention provides a standby weapon platform, which at all times keeps the pistol in an automatically locked, unfireable condition until an officer requires immediate access to a loaded pistol. Drawing and holstering a pistol in the security holster is facilitated through synergistic and automatic action between the dynamics of the pistol and the security holster with locking system. The reholstering of the pistol automatically places the pistol in an unfireable condition by disengaging the trigger and firing pin and withdrawing the slide out of battery, rendering the pistol automatically inoperable, while automatically activating the safety lever on the holster, which firmly locks the pistol into the holster. The rearward drawing action of the pistol while simultaneously releasing the safety lever on the holster with the drawing hand thumb from the security holster automatically transitions the pistol into a full fireable status. An added level of security is provided for a pistol secured in the security holster by means of a tactical pin, which is easily inserted in the holster body, thereby preventing removal of the pistol until the tactical pin is removed. For safe off-duty storage, the security holster offers two locking holes adapted to fit keyed lockable rods for prevention of firing, removing or disassembling the pistol until the locks are removed.

The design of the security holster is configured to accommodate a high intensity illuminator and/or laser sight when the pistol is secured in the holster without adding considerable holster bulk or inaccessibility to the light or laser absent removal of the pistol from the holster. Additionally, the design of the holster provides a holster body which, while secured to a hip mount device, can be elevated up or down over a two-inch range to accommodate the physical characteristics of the pistol carrier. A hip mount provided by the present invention can accommodate belts measuring from ¾ to 2¼ inches in width in an extremely secure status. The hip mount features two mounted compression bolts which firmly lock the holster into a desired position and allow for the holster to be cantered forward or backward to a position preferred by the carrier of the holster.

The significant amount of equipment carried on an officer's duty belt and the constraints provided by the configuration of the driver's seat limit the ability to draw a pistol from a conventional holster in an upward drawing motion. The constraints of wearing body armor and safety belts while driving makes difficult the ability to draw a pistol in an upward motion to clear the three- to five-inch drawing action without telegraphing the draw to a possible opponent. An additional feature of the security holster of the present invention is the unique rearward drawing action accomplished simultaneously by disengaging the holster's safety lever that is connected to the locking system. The safety lever is positioned at a natural position relative to the officer's grip on the pistol. The safety lever moves between an open position and a closed position with only ½-inch movement. The movement of the safety lever between an open position and a closed position is very discreet in the absence of any torso movement whatsoever. During use of the holster, a law enforcement officer can clear the pistol from the holster, even while seated and driving, without obstruction of body armor or seatbelt, while discretely avoiding anyone's notice that the pistol has been drawn. The concealed nature of the draw of a pistol from the security holster renders a law enforcement officer ready for self defense and defense of others. The ability to draw a pistol from the security holster with ease is direly needed in the line of duty. Additionally, the security holster can be worn in a cross draw position, shoulder holster position, or thigh holster position with the same high levels of speed, access and safety associated with wearing the security holster in a position on a belt.

In a desirable embodiment, the security holster is provided with a locking lever that works synergistically with the dimensions and mechanics of a slide action pistol for safe and secure holstering of a pistol and for quick drawing of a loaded pistol from the holster. The security holster includes a three dimensional holster body having a front platform separated from a back platform by a top wall, a right side wall, and a left side wall, all of which define a pistol receiving space.

A slide muzzle end stop is provided adjacent the front platform end of the holster body and within the pistol receiving space of the holster body. The slide muzzle end stop of the holster body is positioned adjacent a barrel muzzle access channel and a slide to lower receiver access channel all positioned adjacent the front platform and within the pistol receiving space of the holster body.

A slide to lower receiver interlock stopping block platform and slide to lower receiver interlock stopping block is provided on the interior surface of the top wall of the holster body.

A securing lever is positioned adjacent to the back platform and within the pistol receiving space of the holster body. The securing lever is connected by a pivot pin and a guide pin that transit through either of the right side wall or the left side wall of the holster body to a locking safety lever. The locking safety lever is positioned adjacent to an exterior surface of either the right side wall or the left side wall depending upon holster configuration. The locking safety lever and securing lever pivot about an axis provided by the pivot pin between an opened position and a closed position. A guide pin guides the locking safety lever and securing lever between the opened position and a closed position in a cam locking lever guide pin positioning slot. An optional cam locking lever pressure spring is provided between the securing lever and the holster body, which biases the securing lever and locking safety lever into a closed position.

The security holster is used to holster, to store and to draw a pistol. To holster a pistol, an operator positions the slide of the pistol into the holster, which automatically moves the securing lever into a corresponding opened position as the pistol enters the holster. In a single forward and downward movement, the front muzzle end of a loaded or unloaded pistol is placed against the slide muzzle end stop, and the grip of the pistol is pushed forward toward the slide muzzle end stop. The muzzle enters the barrel muzzle access channel at a distance that is shorter than the length of a casing of a cartridge. The pistol is then rocked into the pistol receiving space of the holster body. During the rocking motion, the back end of the slide engages the securing lever and forces the securing lever into a closed position, which also forces the locking safety lever into a closed position. At this point, the pistol is holstered in a locked status. Optionally, lynch pins or keyed locking rods can be inserted through holes in the holster body to block either forward movement of the muzzle or movement of the locking safety lever out of the closed position. Drawing the pistol from the holster generally involves reversing the steps of holstering the pistol. With any lynch pin or keyed locking rod removed, the operator pushes the locking safety lever down into the opened position while holding the grip of the pistol and pulling the grip of the pistol in one motion toward the rear of the holster away from the holster. If the pistol was loaded when holstered, the pistol will be drawn ready to fire. If the pistol was not loaded when holstered, the pistol will be drawn unloaded.

The desirable embodiment of the present invention holster is used to secure a pistol having a barrel with a chamber, a muzzle, a slide having a front and rear portion with a front and rear sight situated thereon. Generally, the holster includes a shroud sized to partially receive the pistol therein, wherein the shroud defines a muzzle receiving space substantially near a front portion thereof, and wherein the muzzle receiving space is sized to receive the muzzle and not allow the slide to enter therein. The shroud is a substantially walled open-bottom enclosure sized to substantially accommodate the slide therein. A securing member is movably attached within the shroud substantially near a rear portion thereof, wherein the securing member is shaped to receive a rear portion of the slide. An actuating lever is disposed externally to the shroud and attached via a connecting member to the securing member. Movement of the actuating lever causes the securing member to move between a first and second position. The shroud is adapted to secure the pistol therein when the muzzle is inserted into the muzzle receiving space, the rear portion of the slide is secured within the securing member, and the securing member is positioned in the first position.

The securing member is defined by a vertical member having substantially first and second horizontal members extending from respective ends of the vertical member and extending toward the front portion of the shroud. The securing member is sized to correspondingly mate with at least a top, back, and bottom side of the rear portion of the slide. A spring is disposed between an interior surface of the shroud and the securing member, wherein the spring provides a biasing force that causes the securing member to be maintained in the first position absent any external force applied to the actuating lever.

The connecting member further includes a pin extending through an opening defined within the shroud, wherein the securing member is connected to the pin. The securing member is connected in pivotal relation to the shroud. The actuating lever is positioned in a substantially perpendicular relation to a side of the shroud. A protuberance is attached above and in spaced relation to the actuating lever and extends from the shroud in a substantially perpendicular relation thereto, wherein the width of the protuberance is substantially equal or greater than the width of the actuating lever. Another protuberance extends from an interior surface of the shroud, wherein the protuberance is sized to be received into the chamber when the pistol is secured within the shroud. The holster also includes a first space defined within an upper interior surface of the shroud sized to receive the front sight and a second space defined within the upper interior surface of the shroud sized to receive the rear sight.

The holster may include a first and second hole defined in the rear portion of the shroud for accommodating a rod therethrough, whereby insertion of the rod prevents the movement of the securing member into the second position. The holster may further include a first and second hole defined in the front portion of the shroud for accommodating a rod therethrough, whereby insertion of the rod prevents the movement of the barrel in a forward direction. A groove may be defined along an outside surface of one of the sides of the shroud. Furthermore, a slot may be defined within one of the sides of the shroud for receiving fasteners for securing the holster to a wearable mount.

The present invention also includes a belt worn variable height hip mount for securing the aforementioned holster having a mounting slot defined therein. Generally, the hip mount includes a first curved surface member having a first set of fastener holes defined therein and a second curved surface member having a second set of fastener holes defined therein, wherein the location of the second set of fastener holes substantially corresponds to the location of the first set of fastener holes when the second curved surface member is correspondingly mated with the first curved surface member. This arrangement allows for a space to be provided between the first and second curved surface members to accommodate the belt therethrough. A first set of fasteners adapted to be received through the first set of fastener holes and be secured in the second set of fastener holes is also provided. The first set of fasteners may be compression screws.

Furthermore, a first plurality of mounting holes is defined in at least the first curved surface member and aligned in a substantially vertical orientation thereon. A second set of fasteners adapted to be received through the first plurality of mounting holes to secure the holster to the hip mount is also provided. The second set of fasteners may be corresponding nuts and bolts. The nuts may be adapted to be received adjacent the mounting slot of the holster to allow the corresponding bolts to threadably engage the nuts. The hip mount may include a second plurality of mounting holes defined in the second curved surface member and substantially corresponding to the location of the first plurality of mounting holes of the first curved surface member when the second curved surface member is correspondingly mated with the first curved surface member.

Still other desirable features of the invention will become apparent to those of ordinary skill in the art upon reading and understanding the following detailed description, taken with the accompanying drawings.

DESCRIPTION OF THE PREFERRED EMBODIMENTS

Figure 1:
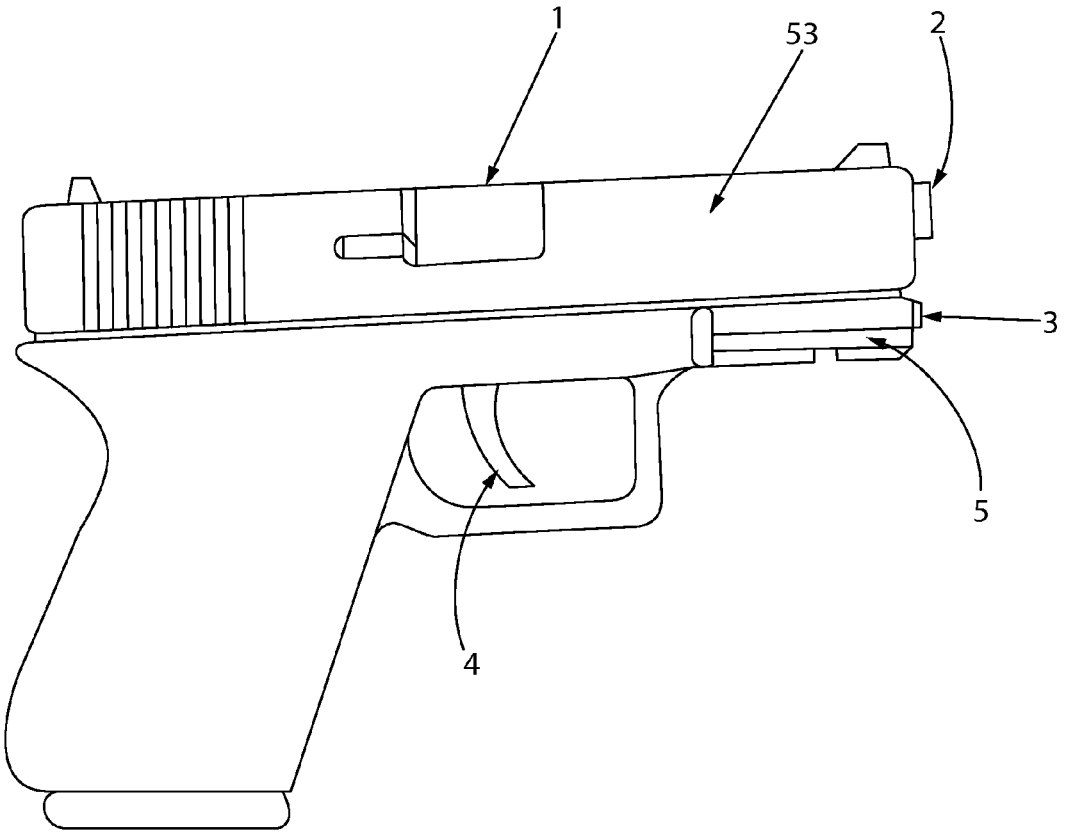
FIG. 1 shows a pistol with a slide closed.

For purposes of the description hereinafter, spatial or directional terms shall relate to the invention as it is oriented in the drawing figures. However, it is to be understood that the invention may assume various alternative variations, except where expressly specified to the contrary. It is also to be understood that the specific apparatus illustrated in the attached drawings, and described in the following specification, is simply an exemplary embodiment of the invention. Hence, specific dimensions and other physical characteristics related to the embodiments disclosed herein are not to be considered as limiting, unless otherwise indicated.

In reference to the disclosure of the invention throughout FIGS. 1-18*b*, similar references to similar parts are used uniformly throughout the disclosure of a security holster 60 including a holster body 10 and a securing lever 62 connected by a pivot pin 16 and a guide pin 64 to a locking safety lever 12. The securing lever 62 and the locking safety lever 12 pivot in concert about the axis provided by the pivot pin 16 between an opened position 19 and a closed position 33. An optional cam locking lever pressure spring 58 is provided to bias the securing lever 62 into the closed position 33. The securing lever 62 and locking safety lever 12 work synergistically with the dimensions and mechanics of a slide 53 of a slide action pistol as disclosed herein.

Referring to FIGS. 3 through 13*c*, the holster body 10 of the security holster 60 includes a front platform 66 separated from a back platform 68, which are connected by a top wall 70, a right side wall 72, and a left side wall 74, all of which define a pistol receiving space 76.

Figure 3:
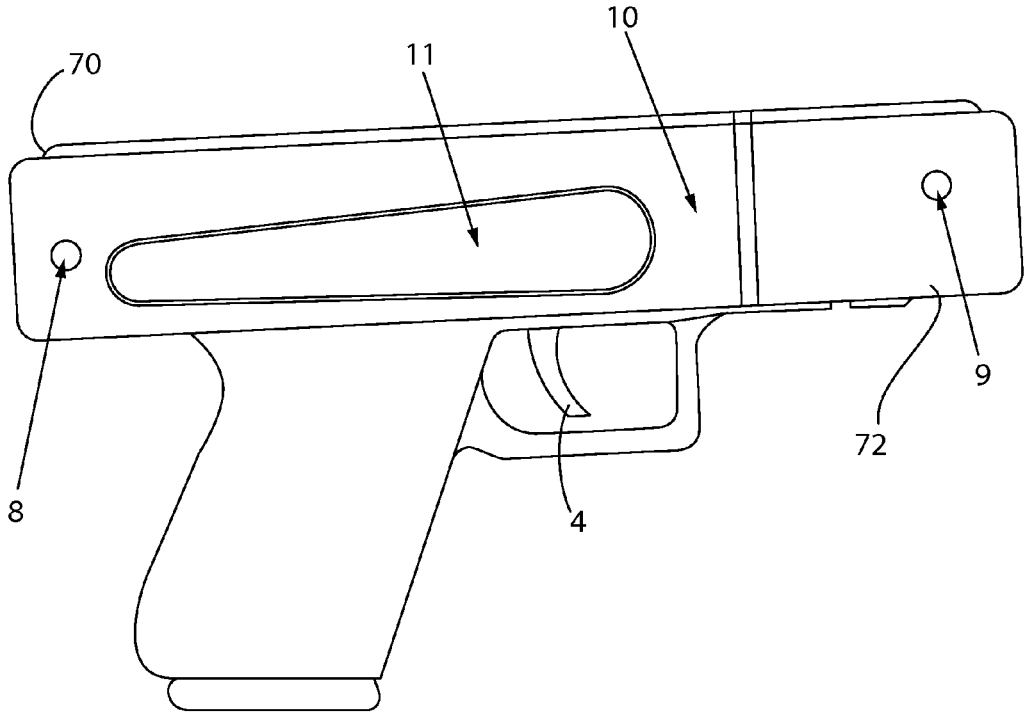
FIG. 3 shows a right side view of a holster securing the pistol of FIG. 1 in accordance with the present invention.
Figure 4:
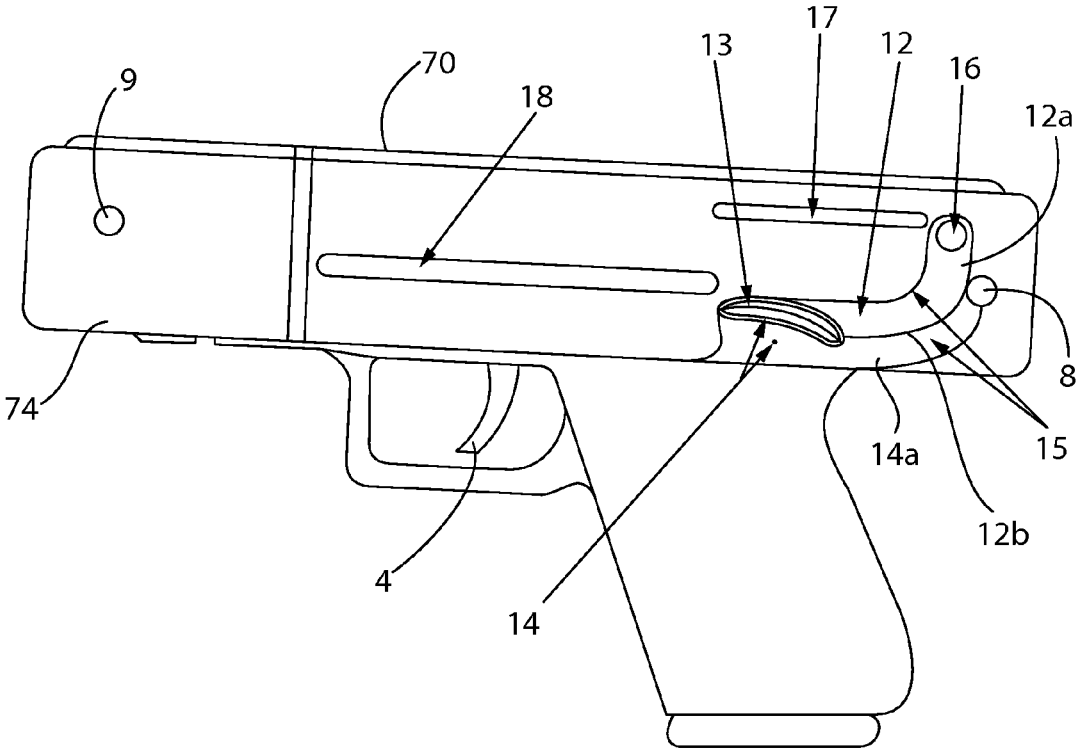
FIG. 4 shows a left side view of the holster securing the pistol as shown in FIG. 3.

Referring to FIGS. 3 and 4, the exterior surface of the holster body 10 includes several structural components. A trigger finger guide groove 11 is provided in the right side wall 72 of the holster body 10 for a right-handed holster and alternatively would be provided in the left side wall 74 of the holster body 10 for a left-handed holster. Corresponding back of holster receiving holes 8 are provided through the right side wall 72 and the left side wall 74 of the holster body 10 adjacent the back platform 68 of the holster body 10. The corresponding back of holster receiving holes 8 are adapted to receiving a lynch pin 38 or key lockable rod 39. Lynch pin 38 and key lockable rod 39 in the corresponding back of holster receiving holes 8 lock a pistol in the security holster 60 by preventing the movement of the locking safety lever 12 from the closed position 33 to an opened position 19. Corresponding front of holster 9 receiving holes are provided through the right side wall 72 and the left side wall 74 of the holster body 10 adjacent the front platform 66 of the holster body 10. The corresponding front of holster receiving holes 9 are adapted to receive a lynch pin 38 or key lockable rod 39. Lynch pin 38 and key lockable rod 39 in the corresponding front of holster receiving holes 9 lock a pistol in the security holster 60 by preventing forward movement of the barrel 1 of a pistol secured in the holster body 10 of the security holster 60.

Referring to FIG. 4, a safety lever shield 17 and securing slot 18 for a holster hip mount are provided with the left side wall 74 of the holster body 10 for right-handed holsters and alternatively are provided with the right side wall 72 of the holster body 10 for left-handed holsters. A locking safety lever receiving space 14*a* is provided between grooved safety lever stops 15 in the left side wall 74 of a holster body 10 of a right-handed security holster 60 and, alternatively, is provided in the right side wall 72 of a holster body 10 of a left-handed security holster. The locking safety lever receiving space 14*a* is generally L-shaped to receive the generally L-shaped locking safety lever 12. The L-shaped locking safety lever 12 includes a first arm 12*a* connected to a second arm 12*b*. The first arm 12*a* is connected to the pivot pin 16 as disclosed herein. A safety lever thumb actuator 13 is provided on the exterior surface of the second arm 12*b* of the locking safety lever 12. A raised member is positioned on the interior surface of the second arm 12*b* of the locking safety lever 12. The raised member engages a first safety lever securing indent 14 provided in the locking safety lever receiving space 14*a* of the holster body 10 when the locking safety lever 12 is in a closed position 33. The raised member engages a second safety lever securing indent 14 provided in the locking safety lever receiving space 14*a* of the holster body 10 when the locking safety lever 12 is in an opened position 19.

Referring to FIGS. 5 through 10, the interior surface of the holster body 10 includes several structural components. A front sight protective pocket 24 is provided at the front of the holster body 10 adjacent the front of the slide to lower receiver interlock stopping block platform 25. A covered rear sight pocket 22 is provided at the back of the holster body 10 adjacent the back of the slide to lower receiver interlock stopping block platform 25.

The securing lever 62 is positioned within the pistol receiving space 76, and the securing lever 62 is connected by a pivot pin 16 and a guide pin 64 to a locking safety lever 12 positioned outside of the receiving space 76 for actuation by an operator.

The securing lever 62 of the security holster 60 is positioned adjacent to the back platform 68 and within the pistol receiving space 76 of the holster body 10. The securing lever 62 is a three-dimensional, U-shaped member including a main body 62*a* with a first arm 62*b* and a second arm 62*c* protruding at substantially a 90 degree angle along a first axis from each end of the main body 62*a*. A pivot pin 16 and a guide pin 64 are provided to connect the securing lever 62 to the locking safety lever 12.

The pivot pin 16 is fixed within the main body 62*a* of the securing lever 62 adjacent the first arm 62*b* of the securing lever 62. A first end and a second end of the pivot pin 16 protrude at a 90 degree angle from the main body 62*a* along a second axis that is generally perpendicular from the first axis of the first arm 62*b* and the second arm 62*c*. The first end and the second end of the pivot pin 16 are housed in corresponding first and second receiving spaces provided in the interior surfaces of the right side wall 72 and the left side wall 74 of the security holster 60. For holsters configured for right-handed operators, the pivot pin 16 transits through the left side wall 74 of the security holster 60 and is fixed within a receiving space of the locking safety lever 12 actionable along the exterior surface of the right side wall 72 of the security holster 60. Alternatively, for holsters configured for left-handed operators, the pivot pin 16 transits through the right side wall 72 of the security holster 60 and is fixed within a receiving space of the locking safety lever 12 actionable along the exterior surface of the right side wall 72 of the security holster 60. The pivot pin 16 provides an axis upon which both the securing lever 62 and locking safety lever 12 pivot together between an opened position 19 and a closed position 33.

The guide pin 64 is fixed within the main body 62*a* of the securing lever 62 adjacent the second arm 62*c* of the securing lever 62. A first end and a second end of the guide pin 64 protrude at a 90-degree angle from the main body 62*a* along the second axis parallel the pivot pin 16 and generally perpendicular from the first axis of the first arm 62*b* and the second arm 62*c*. For holsters configured for right-handed operators, a cam locking lever driving pin positioning slot 57 provides a slot that transits through the left side wall 74 of the security holster 60. The first end of the pivot pin 16 protrudes into the cam locking lever driving pin positioning slot 57. The second end of the pivot pin 16 is flush against the surface of the securing lever 62. The first end of the guide pin 64 guides the movement of the securing lever 62 and locking safety lever 12 to pivot in concert between the opened position 19 and the closed position 33. Alternatively, for holsters configured for-left handed operators, a cam locking lever driving pin positioning slot 57 provides a slot that transits through the right side wall 72 of the security holster. The second end of the pivot pin 16 protrudes into a cam locking lever driving pin positioning slot 57. The first end of the pivot pin 16 is flush against the surface of the securing lever 62. Furthermore, an additional second cam locking lever driving pin positioning slot 57 can be provided opposing the first cam locking lever driving pin positioning slot 57 provided in either a left-handed or right-handed holster. In this case, the first end and the second end of the guide pin 64 protrude into each of the opposing cam locking lever driving pin positioning slot 57 provided in the right side wall 72 and the left side wall 74 of the security holster. With this configuration, the first end and the second end of the guide pin 64 guide the movement of the securing lever 62 and locking safety lever 12 to pivot in concert between the opened position 19 and the closed position 33.

Alternatively, for left-handed operators, the securing lever 62 is connected by a pivot pin 16 and a guide pin 64 that transit through the right side wall 72 of the holster body 10 to an actionable locking safety lever 12. With this configuration, the locking safety lever 12 is positioned adjacent to an exterior surface of the right side wall 72. The locking safety lever 12 is positioned adjacent to an exterior surface of either the right side wall 72 or the left side wall 74 depending upon holster configuration. The locking safety lever 12 and securing lever 62 pivot about an axis provided by the pivot pin 16 between an opened position 19 and a closed position 33. A guide pin 64 guides the locking safety lever 12 and securing lever 62 between the opened position 19 and a closed position 33 in a cam locking lever guide pin positioning slot 57. An optional cam locking lever pressure spring 58 is provided between the securing lever 62 and the holster body 10, which biases the securing lever 62 and lockable safety lever 12 into a closed position 33.

Referring to FIGS. 5 through 10, a slide muzzle end stop 29 of the holster body 10 of the security holster 60 is provided adjacent the front platform 66 of the holster body 10 and within the pistol receiving space 76 of the holster body 10. The slide muzzle end stop 29 is connected to the right side wall 72, the left side wall 74, and the top wall 70 of the security holster 60. The slide muzzle end stop 29 is positioned parallel to and adjacent the front platform 66 of the holster body 10. The slide muzzle end stop 29 includes a hole or receiving space configured to receive a barrel 1 of a pistol without impeding movement of the barrel 1 through the hole. Additionally, the slide muzzle end stop 29 of the holster body 10 is positioned adjacent a barrel muzzle access channel 27 and a slide to lower receiver access channel 28 all positioned adjacent the front platform 66 and generally within the pistol receiving space 76 of the holster body 10. The interior surface of the front platform 66 is a first length from the slide muzzle end stop 29. The first length provides a distance that a barrel 1 of a pistol can be inserted into the barrel muzzle access channel 27 that is generally shorter than the length of a cartridge casing in order to prevent ejection of a chambered round in the pistol as the pistol is being holstered in the security holster 60. Optionally, a stop can be provided on the interior surface of the front platform 66 to limit the distance that the barrel 1 is inserted into the barrel muzzle access channel 27.

A slide to lower receiver interlock stopping block platform 25 and slide to lower receiver interlock stopping block 26 is provided on the interior surface of the top wall 70 of the holster body 10 of the security holster 60. The slide to lower receiver interlock stopping block 26 protrudes from the slide to lower receiver interlock stopping block platform 25 at a distance that allows the slide to lower receiver interlock stopping block 26 to rest against a casing of a cartridge chambered in the pistol. The slide to lower receiver interlock stopping block 26 is positioned at a distance from the slide muzzle end stop 29 of the holster body 10 of the security holster 60. The distance is generally approximately slightly longer than the barrel length of the pistol so that the slide to lower receiver interlock stopping block 26 can rest against a casing of a cartridge positioned in the chamber of a pistol holstered in the security holster 60.

In order to understand the action of the security holster 60, the relationship of the positions of a slide 53 and a lower receiver of a pistol suitable for use with the security holster 60 as shown in FIG. 1 should be understood. The pistol has a cartridge chambered into battery. The slide 53 and the lower receiver are locked together by the expansion of the recoil spring, placing the trigger 4 in an activated condition ready to fire when pulled. FIG. 1 indicates that the barrel 1 is locked in battery with the firing chamber fully closed. The barrel muzzle 2 is in its set position relative to the closed chamber 6 of the pistol. Guide rod 3 has expanded its spring to its most relaxed status, ready for full compression under the reciprocating opposing forces to be exerted upon the pistol when fired. Upon firing the pistol, the force of the discharged round leaving the pistol causes the slide 53 to recoil to the rear of the pistol. As the slide 53 recoils, the chamber 6 becomes opened and at the same time the extractor of the pistol ejects the spent cartridge. As the recoil spring expands, the slide 53 returns to a forward position and a cartridge is removed from the magazine and inserted into battery. With the slide 53 in the most forward position, the barrel 1 is fully locked within the slide 53, which is locked proportionally to the lower receiver of the pistol. In this condition, the pistol is ready to be fired again. The trigger 4 actuates the reciprocating parts by firing the pistol. A mounting rail 5 is provided with the pistol for mounting a high-intensity illuminator and/or a laser sight.

Figure 2:
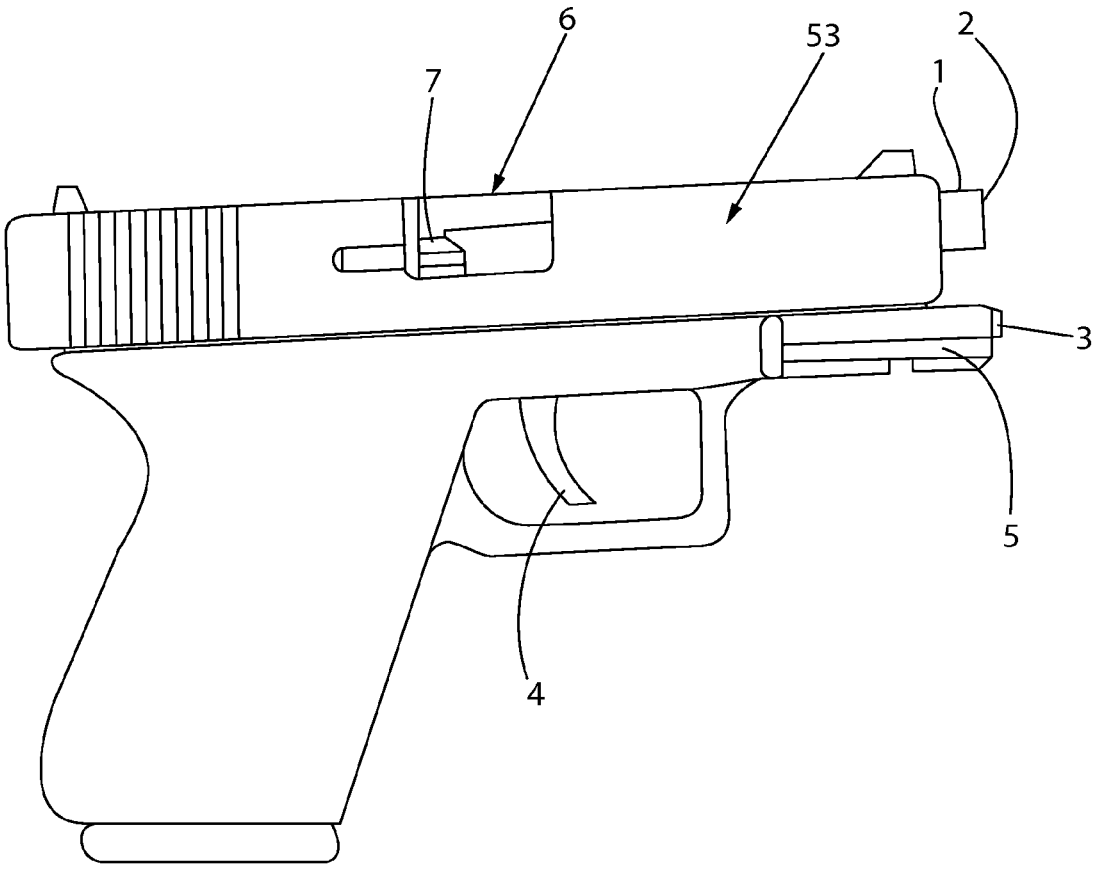
FIG. 2 shows a pistol with a slide partially opened.

Referring to FIG. 2, the relationship of the positions of the slide 53 and the lower receiver of the pistol are shown as if the pistol were contained in the security holster 60. When a pistol is secured in the security holster 60, the slide 53 and the lower receiver are not locked together, as indicated by the open chamber 6 with a portion of the cartridge 7 retained by the extractor. Barrel muzzle 2 is shown slightly exposed as the pistol slide 53 is in a partially retracted condition. In the slightly retracted condition, the pistol cannot fire as the interface between the lower receiver trigger assembly and firing pin actuator are interrupted by the partially open chamber of the partially open slide 53. The trigger 4 will not function with the firing pin and, therefore, the gun cannot fire.

Referring to FIG. 3, the right side of the security holster 60 with holster body 10 is shown with a right hand configuration securing a pistol. The back of holster receiving hole 8 is shown capable of receiving a lynch pin 38 or key lockable rod 39, and the front end locking hole 9 is shown for insertion of lynch pin 39 or key lockable rod 39. The trigger finger guide groove 11 for a right-handed user is shown. The trigger finger guide groove 11 protects the trigger finger from accessing the trigger 4 of the pistol when holstering and drawing the pistol from the security holster 60.

Referring to FIG. 4, the left side of the security holster 60 with holster body 10 is shown with a right hand configuration securing a pistol. The safety lever shield 17 protrudes from the holster body 10 as a physical shield against a frontal assault, denying access to the locking safety lever 12 and the safety lever thumb actuator 13. The thumb safety lever securing detents 14 serve to secure the locking safety lever 12 in a closed position 33 as shown in FIG. 4 or in an opened position 19. The grooved safety lever stops 15 control the pivoting movement of the locking safety lever 12. The locking safety lever 12 and pivot pin 16 pivot about a first axis between a closed position 33 as shown in FIG. 4 or in an opened position 19. Safety lever shield 17 is positioned in front of the locking safety lever 12 to protect against a frontal grab by securing the safety lever thumb actuator 13. The securing slot 18 provides for an adjustment factor of over two inches when the holster body 10 is secured with a variable height hip mount 40.

Figure 5:
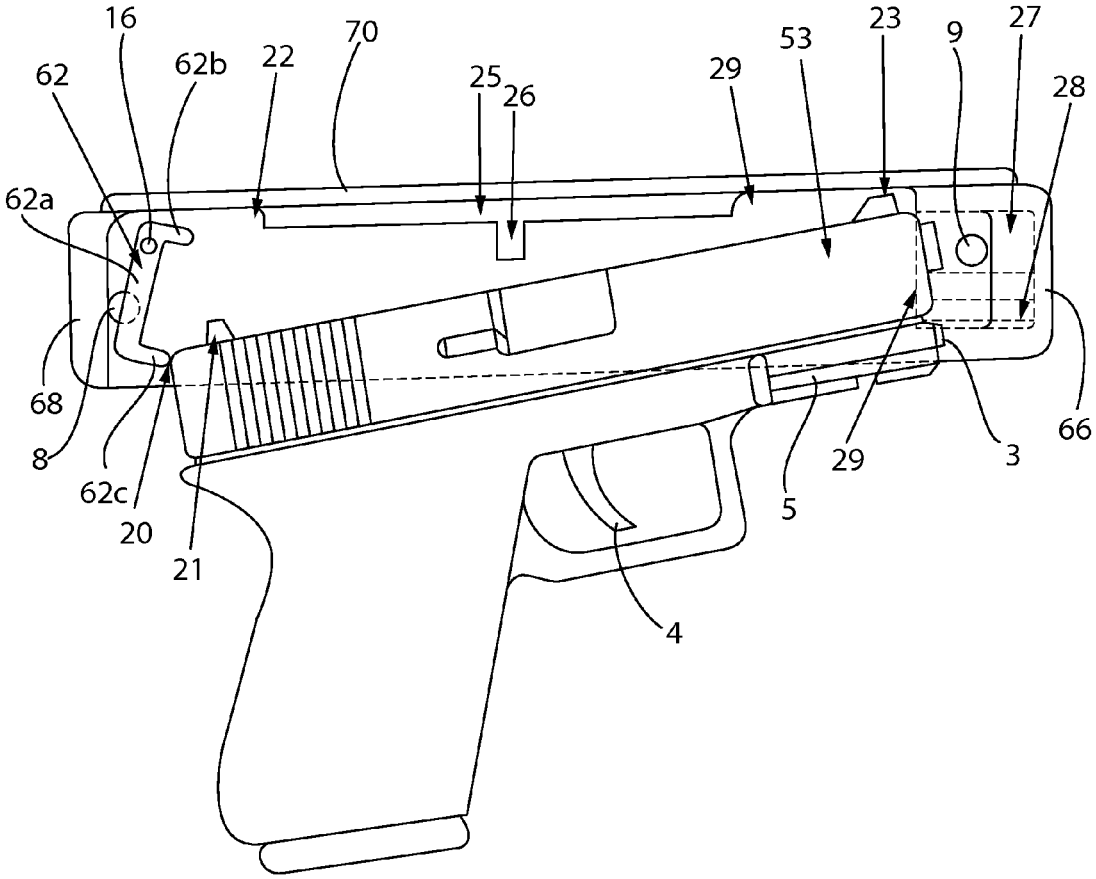
FIG. 5 shows a partial sectional view of the right side of the holster with a cam locking lever shown in FIG. 3 having a pistol partially inserted.

Referring to FIG. 5, a pistol is shown partially inserted into the pistol receiving space 76 of the holster body 10. The securing lever 62 is shown in an opened position 19 so that the second arm 62*c* of the securing lever 62 contacts with the top rear of slide 20, while at the same time the slide 53 engages the bearing surface of the slide muzzle end stop 29. The guide pin 64 is in the rear portion of the cam locking lever driving pin positioning slot 57. As shown, the slide 53 is aligned with the entry point of the barrel muzzle access channel 27, the slide muzzle end stop 29 and the slide to lower receiver interface channel 28. The covered rear sight pocket 22 is shown prepared to receive the rear sight 21 of the pistol. The front sight protective pocket 24 is shown receiving the front sight 23 of the pistol. The slide to lower receiver interlock stopping block platform 25 and slide to lower receiver interlock stopping block 26 are shown on the interior surface of the top wall 70 of the holster body 10 of the security holster 60.

Figure 6:
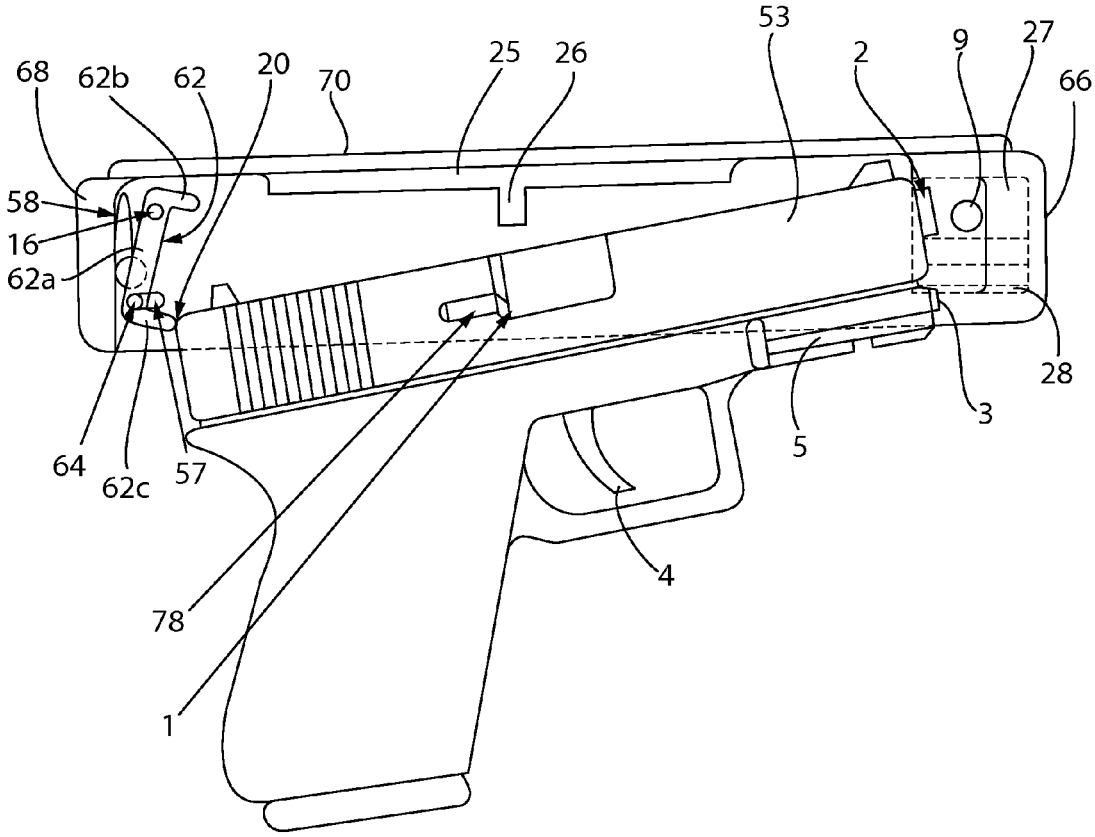
FIG. 6 shows a partial sectional view of the right side of the holster with an alternative cam locking lever shown in FIG. 3 having a pistol partially inserted.

Referring to FIG. 6, a pistol is shown partially inserted into the pistol receiving space 76 of the holster body 10 similar to FIG. 5. The optional cam locking lever pressure spring 58 is shown positioned between the securing lever 62 and the back platform 68 of the holster body 10. Cam locking lever pressure spring 58 is shown compressed as the securing lever 62 is in the opened position 19 from downward pressure on the locking safety lever 36 by the thumb of an operator's hand, which causes the locking safety lever to move to the opened position 19 as shown in FIG. 6. In the opened position 19, the pistol can be inserted into the security holster 60 with a short forward movement of the grip or alternatively removed from the security holster 60 with a short rearward movement of the grip.

Figure 7:
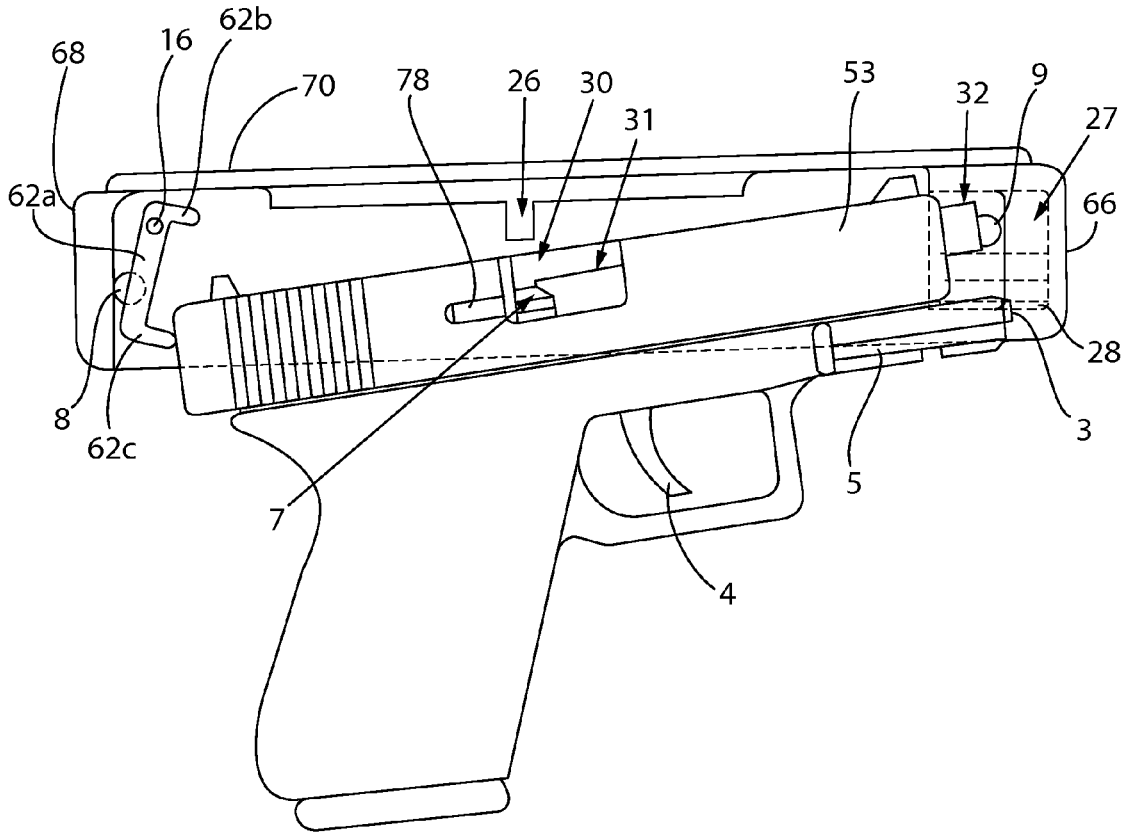
FIG. 7 shows a partial sectional view of the right side of the holster with the cam locking lever as shown in FIG. 5 with the pistol further inserted therein.

Referring to FIG. 7, the securing lever 62 is shown in an opened position 19 bearing on the top of the slide 53 as pressure is exerted in a downward motion against the pistol. With the downward motion, the pistol has a partially opened chamber 30 causing by the tipped and forward positioned barrel breach 31 and the protruding barrel muzzle end 32 entering the barrel muzzle access channel 27. The cartridge 7 is retained by the extractor, which has partially withdrawn the cartridge, previously in battery, out of battery. In this condition, the cartridge is in an unfireable position because the trigger 4 is automatically disengaged when the slide 53 and lower receiver are not positively locked together with the chamber 6 fully closed and locked. With the chamber 6 partially open, the slide to lower receiver interlock stopping block 26 is in line to enter the chamber 6 when the pistol is rotated forward into the holster body 10.

Figure 8:
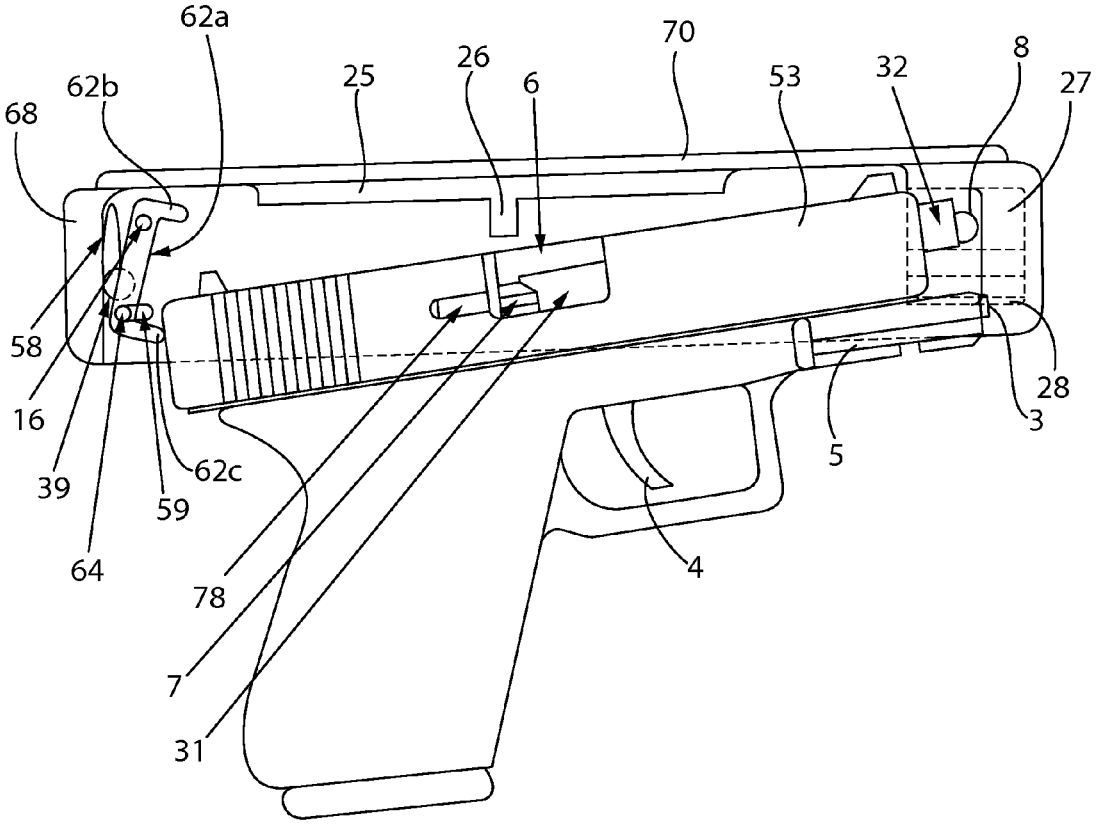
FIG. 8 shows a partial sectional view of the right side of the holster with the alternative cam locking lever as shown in FIG. 6 with the pistol further inserted therein.

Referring to FIG. 8, a pistol is shown partially inserted into the pistol receiving space 76 of the holster body 10 similar to FIG. 7. The pistol is shown halfway inserted into the security holster 60, keeping pressure on the distal end of the securing lever 62 in an opened position 19 and compressing the cam locking lever pressure spring 58. The cam locking lever driving pin 56 moves through the cam locking lever driving pin positioning slot 57, causing a corresponding downward movement of the locking safety lever 12 into a closed position 33.

Figure 9:
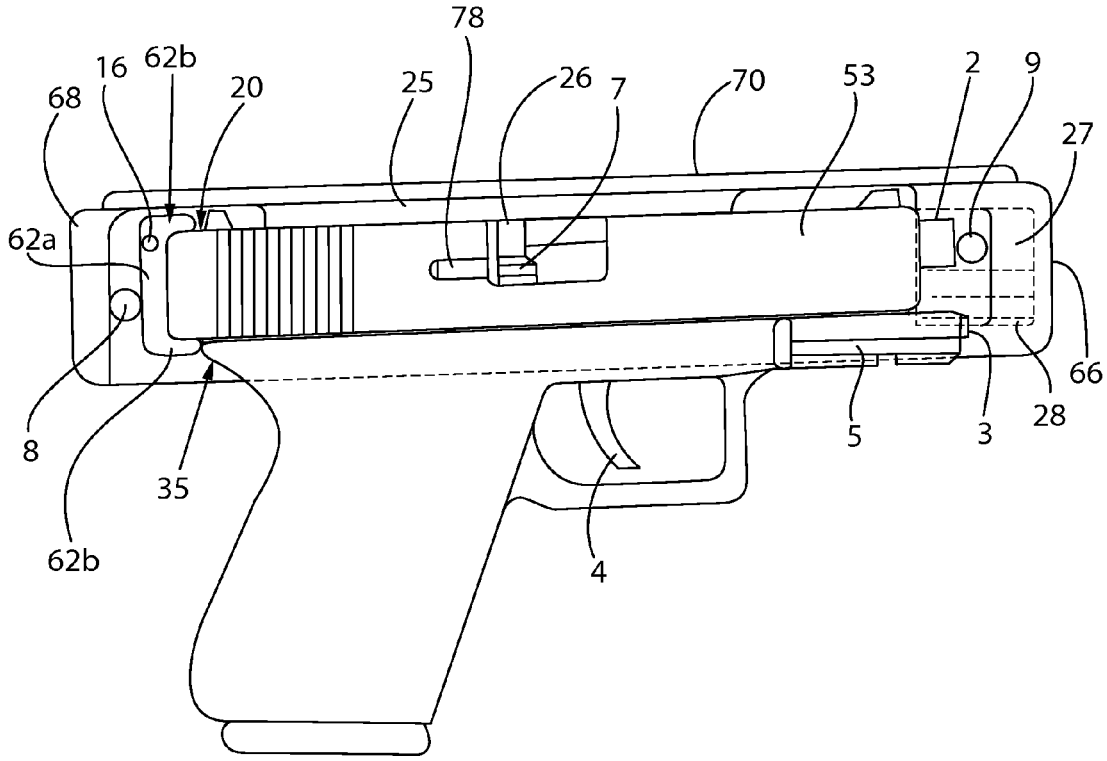
FIG. 9 shows a partial sectional view of the right side of the holster with the cam locking lever as shown in FIG. 5 with the pistol secured therein.

Referring to FIG. 9, the pistol is shown holstered in the security holster 60. With the pistol secured in a holstered state, the cam locking lever 34 has been pivoted into a closed position 33 such that the first arm 62*b* of the securing lever 62 captures the top rear of slide 20 and the second arm 62*c* of the securing lever 62 captures the bottom rear of slide 53, thereby actuating the locking safety lever 12 into a closed position 33. The lower receiver bearing point 35 of the pistol contacts the second arm 62*c* of the securing lever 62 to prevent rearward motion of the lower receiver of the pistol.

Figure 10:
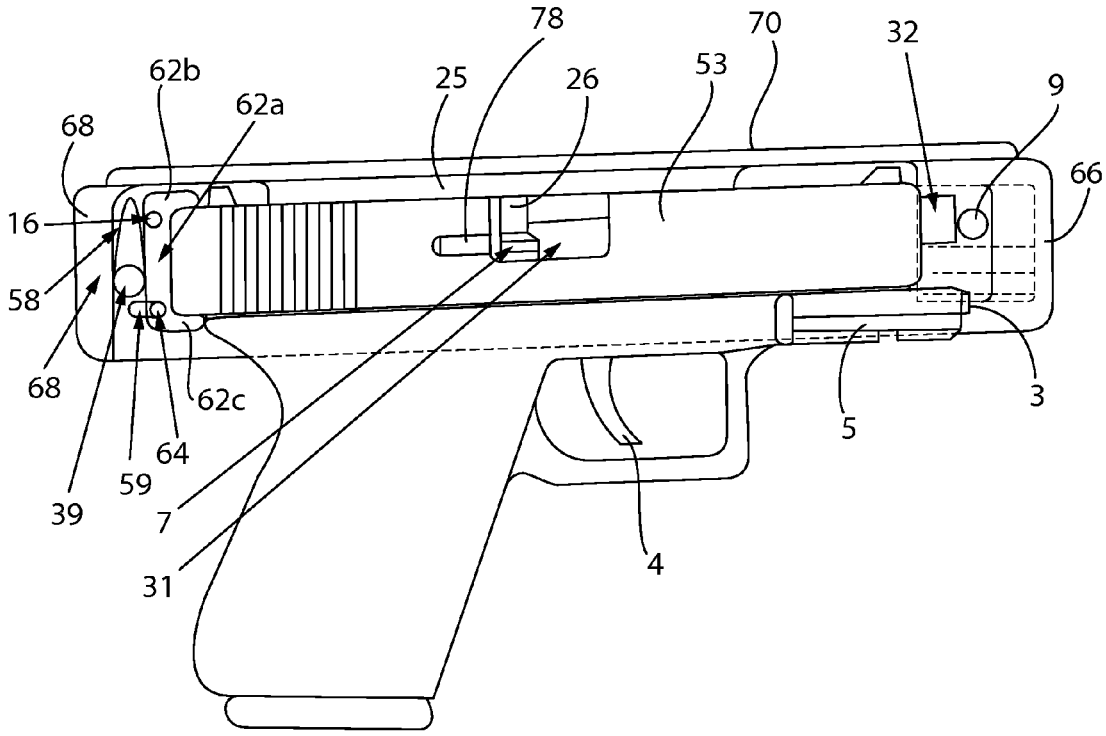
FIG. 10 shows a partial sectional view of the right side of the holster with the alternative cam locking lever as shown in FIG. 6 with the pistol secured therein.

Referring to FIG. 10, the pistol is shown holstered in the security holster 60 similar to FIG. 9. The pistol is secured by the securing lever 62 in a closed position 33 in the security holster 60, thereby allowing the cam locking lever pressure spring 58 to bias the securing lever 62 and the locking safety lever 12 into the closed position 33. The pistol is removed from its locked position in the security holster 60 by gripping the pistol's grip and depressing the locking safety lever 12 into an opened position 19 in a relatively short downward and rearward motion while simultaneously moving the pistol away from the holster body 10.

Figure 11A:
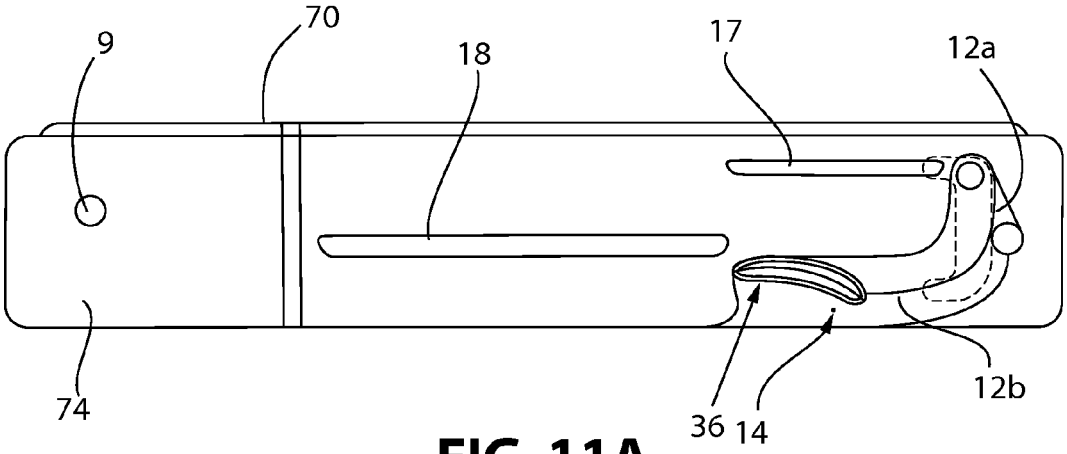
FIG. 11*a* shows a left side view of the holster with a locking safety lever in a closed position.
Figure 11B:
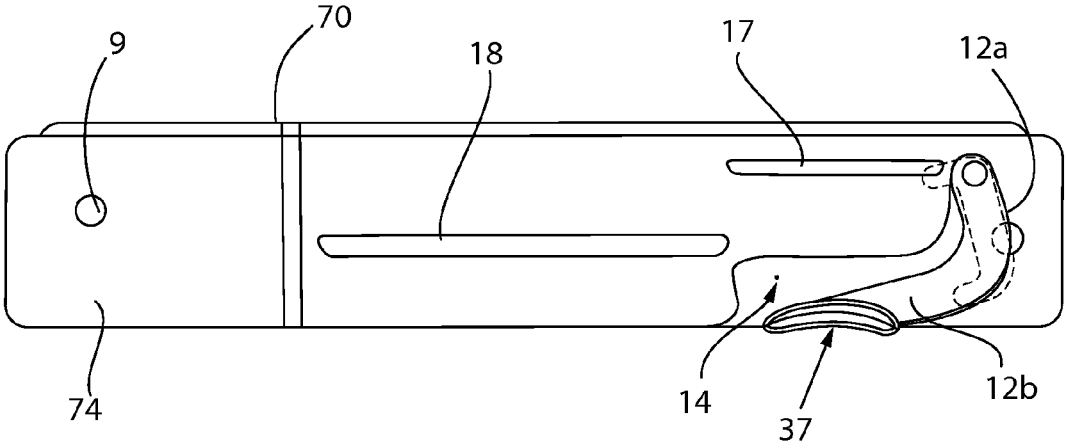
FIG. 11*b* shows a left side view of the holster with a locking safety lever in an opened position.
Figure 11C:
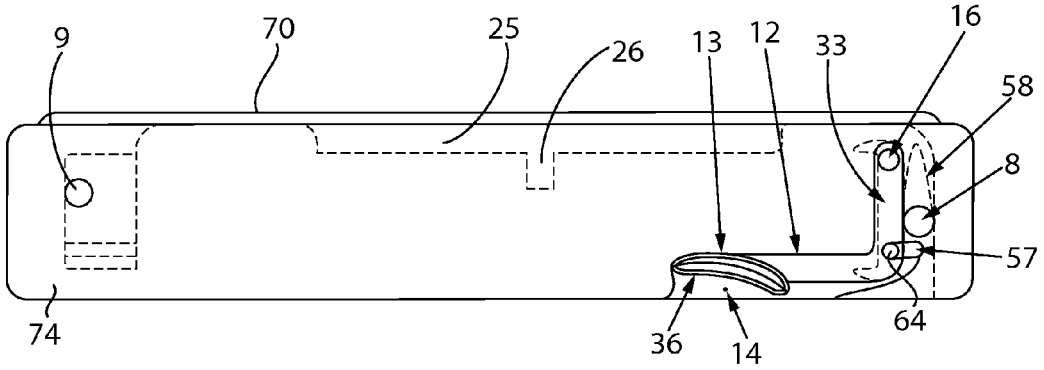
FIG. 11*c* shows a left side view of the holster with a locking safety lever in an opened position.
Figure 11D:
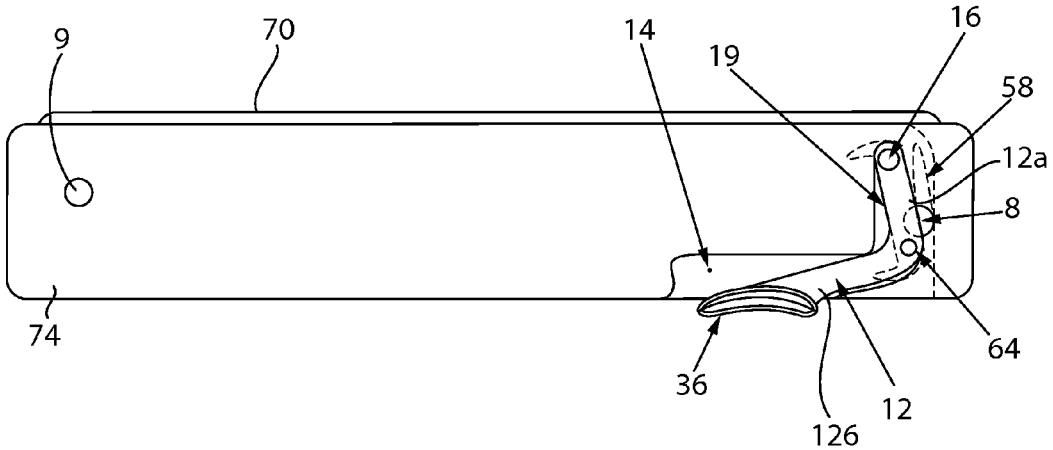
FIG. 11*d* shows a left side view of the holster with a locking safety lever in an opened position.

Referring to FIG. 11*a*, an embodiment of the locking safety lever 12 is shown in a closed position 33. Referring to FIG. 11*b*, the embodiment of the locking safety lever 12 shown in FIG. 11*a* is shown in an opened position 19. Furthermore, in reference to FIG. 11*c*, an alternative embodiment of the locking safety lever 12 is shown in a closed position 33. Referring to FIG. 11*d*, the embodiment of the locking safety lever 12 shown in FIG. 11*c* is shown in an opened position 19.

Figure 12A:
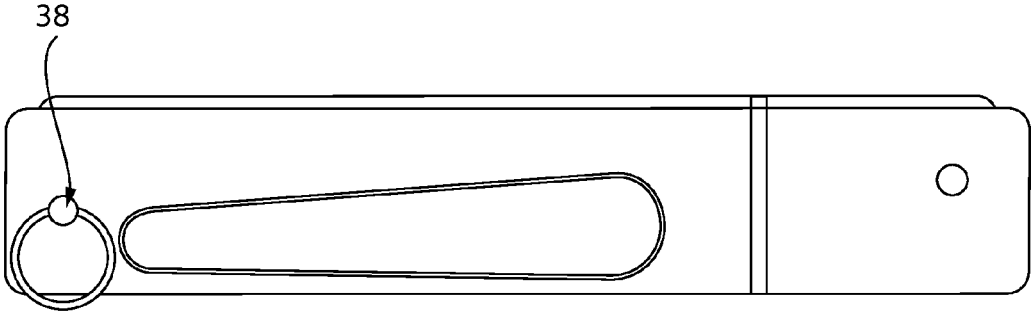
FIG. 12*a* shows a right side view of the holster shown in FIGS. 11*a* and 11*b* with a ringed lynch pin.
Figure 12B:
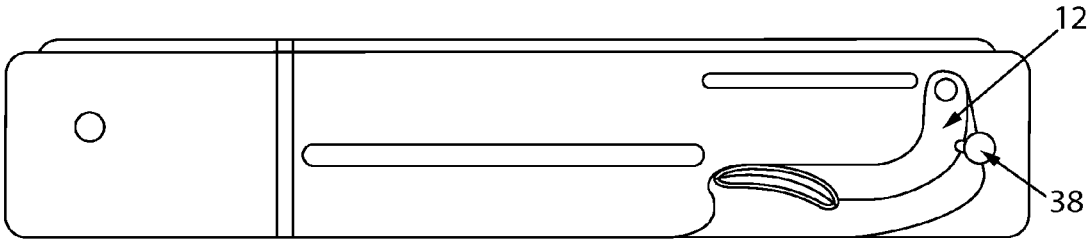
FIG. 12*b* shows a left side view of the holster shown in FIGS. 11*a* and 11*b* with a ringed lynch pin.
Figure 12C:
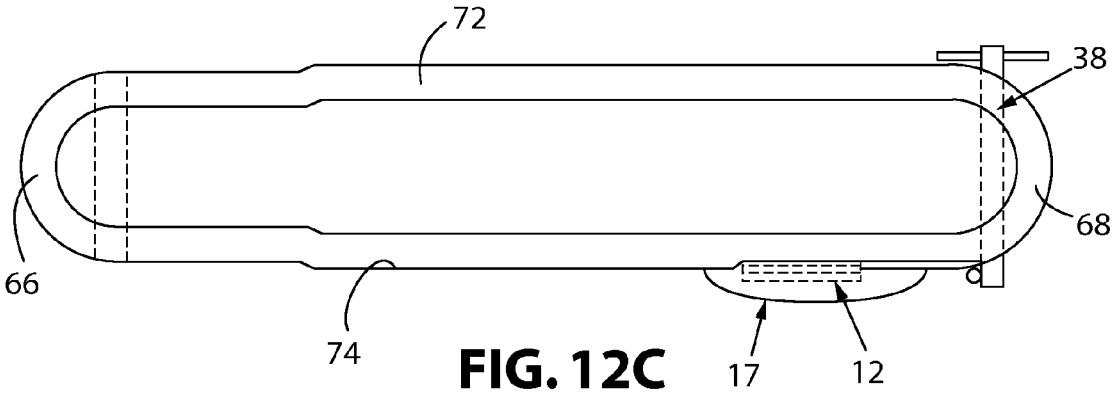
FIG. 12*c* shows a bottom view of the holster shown in FIGS. 11*a-b* and 12*a-b* with a ringed lynch pin.

Referring to FIG. 12*a*, a lynch pin 38 is shown inserted in the front of holster receiving holes 9, which would prevent the forward movement of a barrel 1 of a pistol holstered in the security holster 60. Alternatively, the lynch pin 38 is shown inserted in the rear of holster receiving holes in FIGS. 12*b* and 12*c*, thereby securing the locking safety lever 12 into a closed position 33.

Figure 13A:
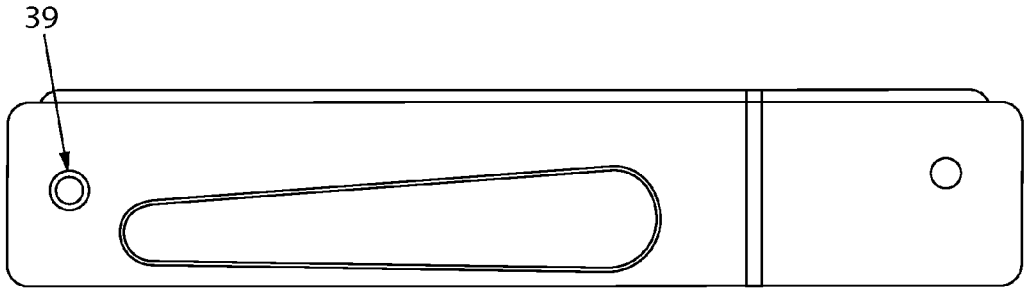
FIG. 13*a* shows a right side view of the holster shown in FIGS. 11*a* and 11*b* with a lockable locking rod.
Figure 13B:
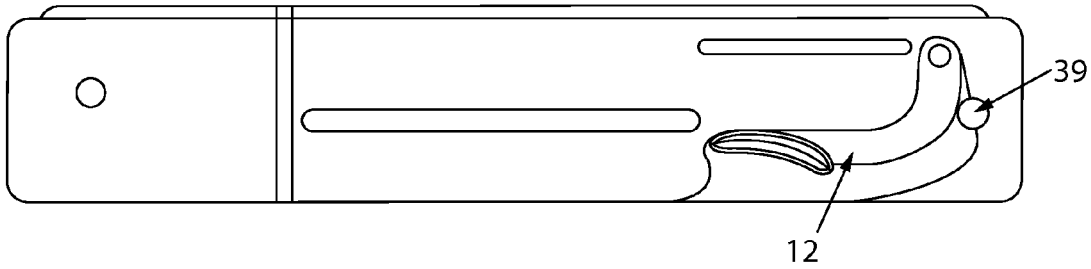
FIG. 13*b* shows a left side view of the holster shown in FIGS. 11*a* and 11*b* with a lockable locking rod.
Figure 13C:
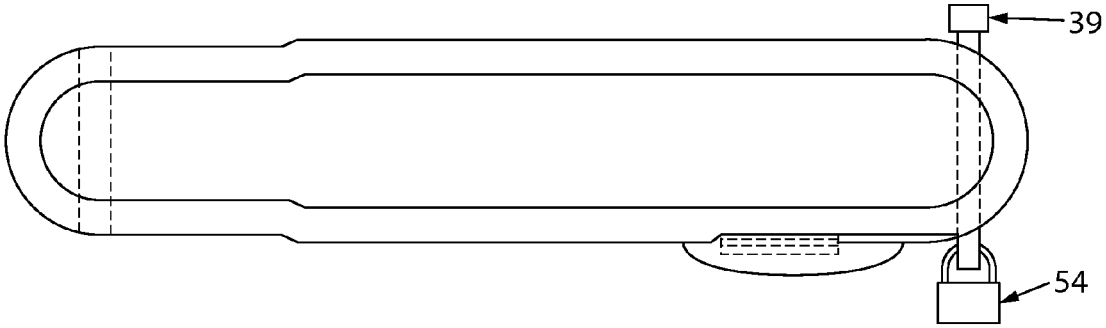
FIG. 13*c* shows a bottom view of the holster shown in FIGS. 11*a-b* and 12*a-b* with a lockable locking rod.
Figure 14A:
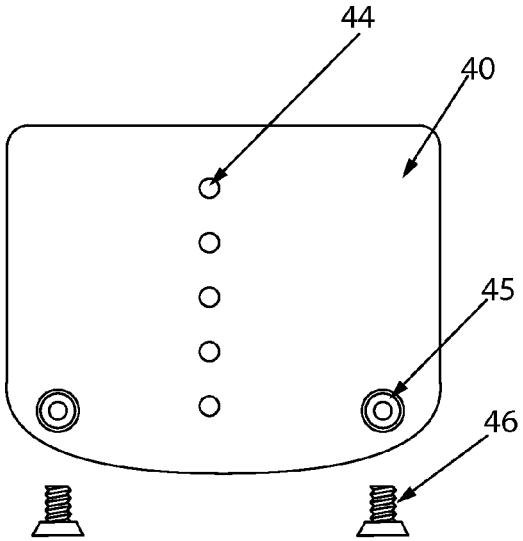
FIG. 14*a* shows a front view of variable height hip mount.
Figure 14C:
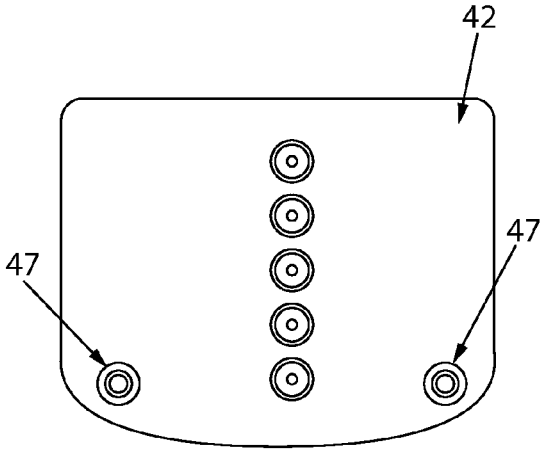
FIG. 14*c* shows a back view of variable height hip mount.
Figure 14B:
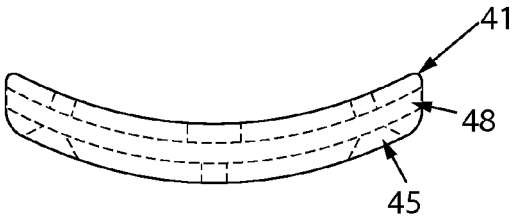
FIG. 14*b* shows a top front view of variable height hip mount.
Figure 14D:
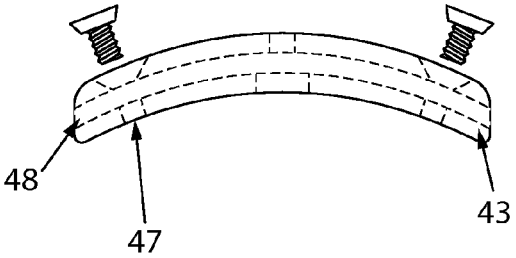
FIG. 14*d* shows a top front view of variable height hip mount.

Referring to FIG. 13*a*, a key lockable rod 39 is shown inserted in the front of holster receiving hole 9, which would prevent the forward movement of a barrel 1 of a pistol holstered in the security holster 60. Alternatively, a key lockable rod 39 is shown inserted in the rear of holster receiving holes in FIGS. 13*b* and 13*c*, thereby securing the locking safety lever 12 into a closed position 33.

Referring to FIGS. 14*a* through 14*d*, a variable height hip mount 40 is shown with multiple screw mounting holes 44 and access holes 45. The multiple screw mounting holes 44 are adapted to receive screws that secure the holster body 10 through the securing slot 18 to the variable height hip mount 40. Compression screws 46 are shown, which are used to secure the front of the variable height hip mount 40 to the back of the variable height hip mount 40.

Figure 15A:
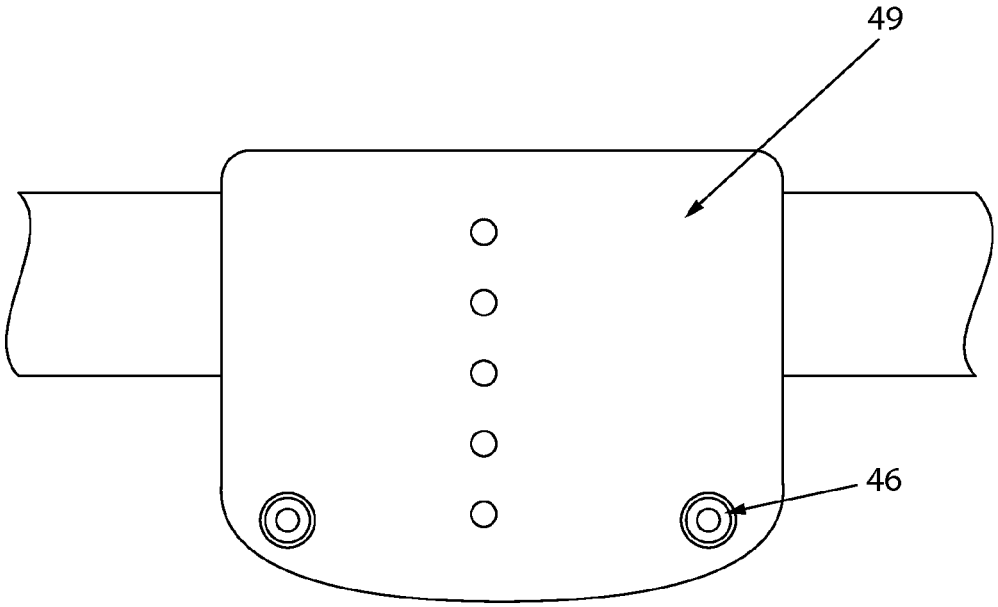
FIG. 15*a* shows a front view of variable height hip mount shown in FIG. 14*a* engaging a belt.
Figure 15B:
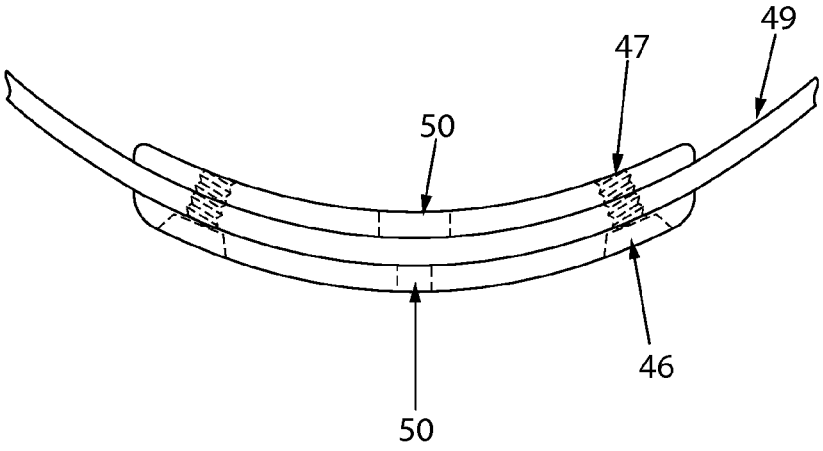
FIG. 15*b* shows a front view of variable height hip mount shown in FIG. 15*a* engaging a belt.

Referring to FIGS. 15*a* and 15*b*, the front of the variable height hip mount 40 is shown secured to the back of the variable height hip mount 40 with compression screws 46. A belt 49 is shown inserted through the variable height hip mount 40.

Figure 16:
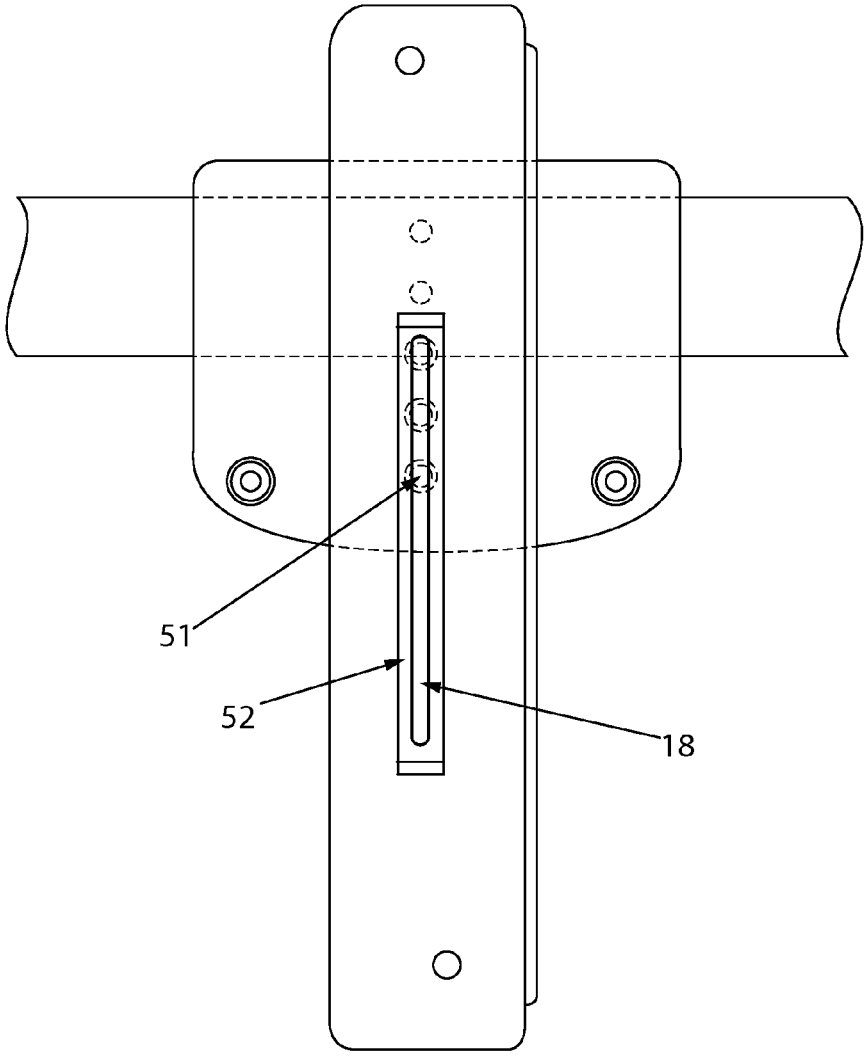
FIG. 16 shows a front view of the holster secured to the variable height hip mount.
Figure 17:
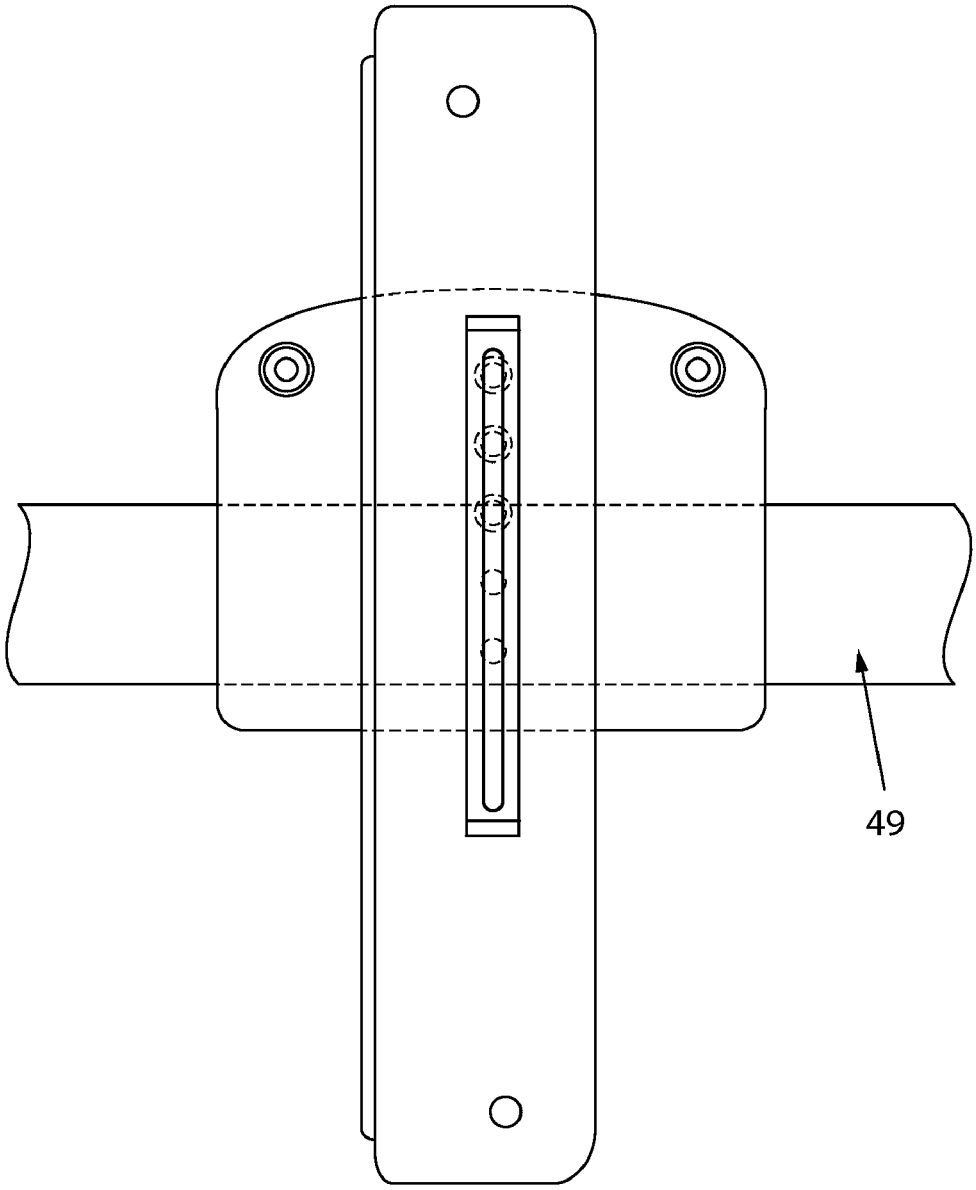
FIG. 17 shows a front view of the holster secured at a lower position to the variable height hip mount.

Referring to FIG. 16, a holster body 10 of the security holster 60 is shown secured by a plurality of bolts and corresponding nuts to multiple screw mounting holes 44 of the variable height hip mount 40 secured to a belt with compression screws 46. The holster body 10 is shown securing the variable height hip mount 40 in a relatively low position. Alternatively, the holster body 10 is shown in FIG. 17 secured to the variable height hip mount 40 in a relatively high position.

Figure 18A:
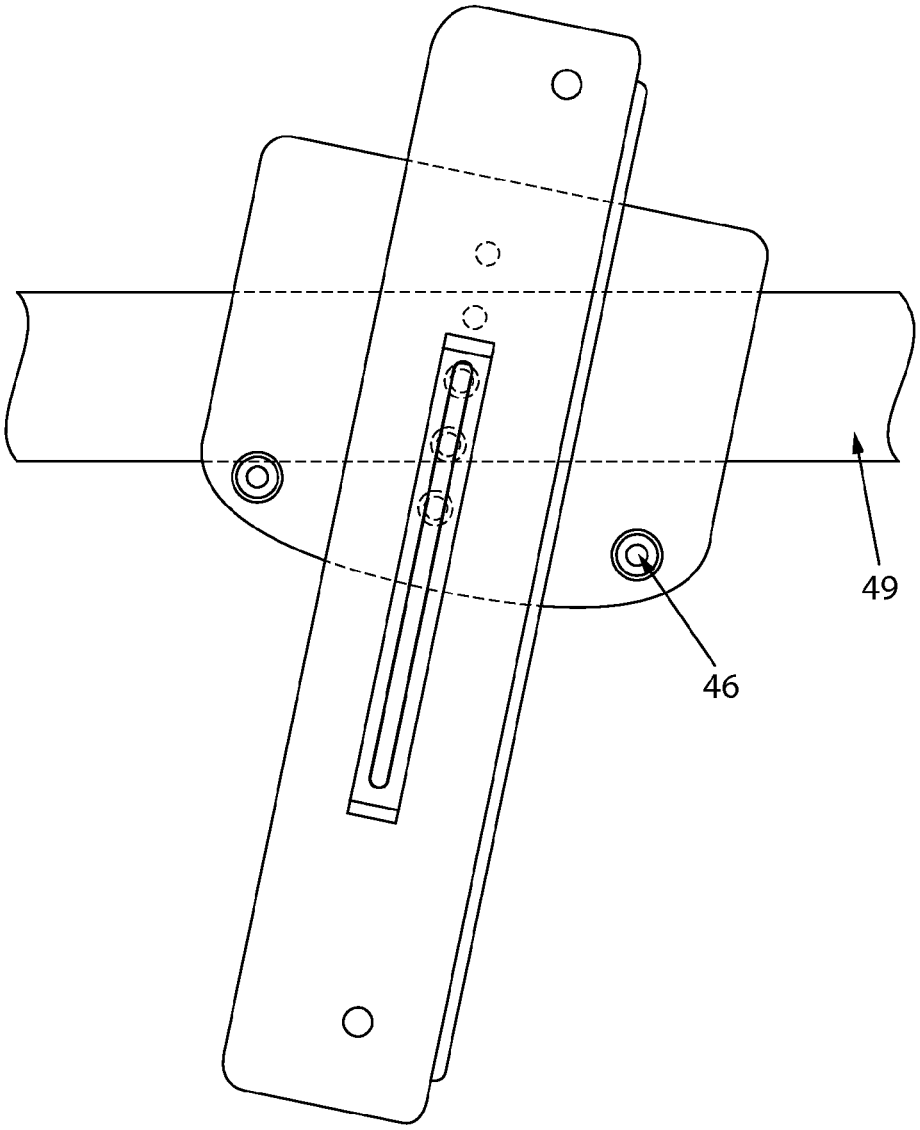
FIG. 18*a* shows a front view of the holster secured at a forward cant position to the variable height hip mount.
Figure 18B:
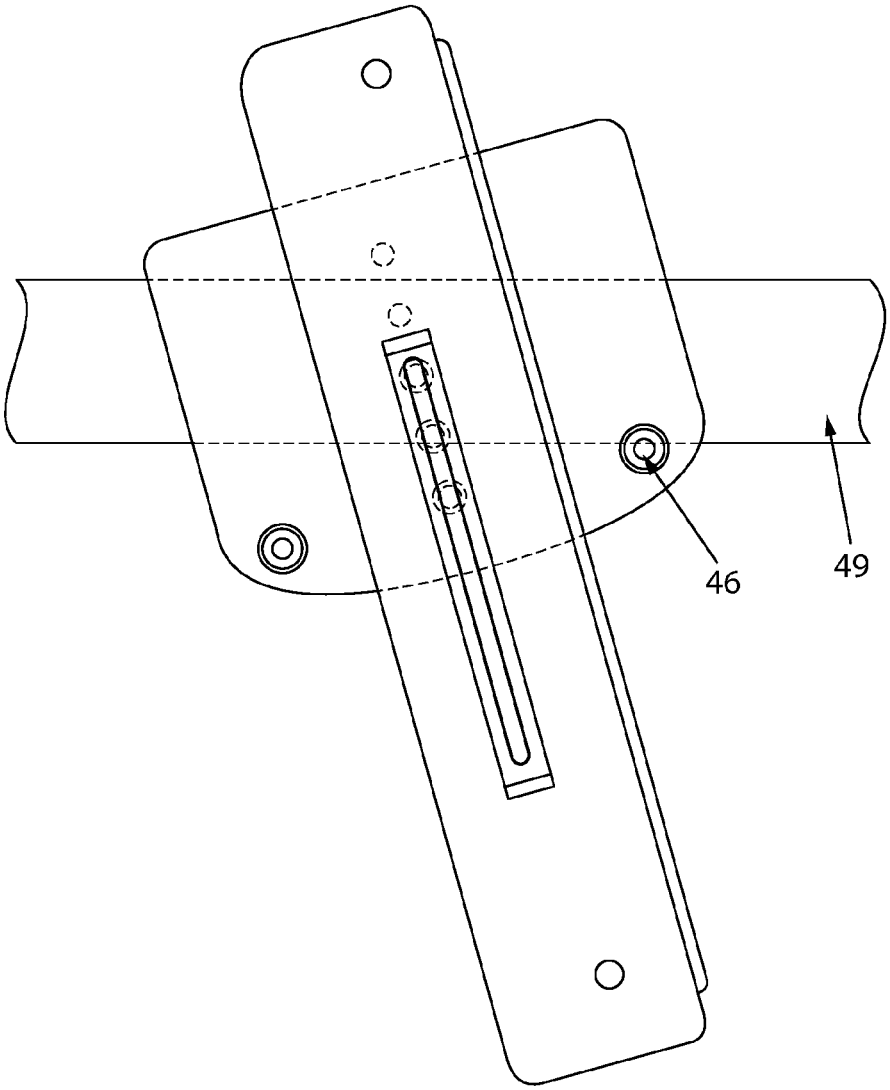
FIG. 18*b* shows a front view of the holster secured at a backward cant position to the variable height hip mount.

Referring to FIGS. 18*a* and 18*b*, a holster body 10 of the security holster 60 is shown secured by a plurality of bolts and corresponding nuts to multiple screw mounting holes 44 of the variable height hip mount 40 secured to a belt with compression screws 46. The holster body 10 is shown in a forward cant position in FIG. 18*a*. Alternatively, the holster body 10 is shown in a backward cant position in FIG. 18*b*.

In accordance with the invention, a pistol can be holstered in the security holster 60 without any need to change the configuration or parts of the pistol. The locking system works in synergy with the structure and mechanical function of the pistol.

All components of the security holster 60 can be manufactured from plastic polymer, metal, and/or any other suitable material known in the art.

The present invention has been described with reference to the preferred embodiments. Modifications, combinations and alterations will occur to others upon reading the preceding detailed description. It is intended that the invention be construed as including all such modifications, combinations and alterations insofar as they come within the scope of the appended claims or the equivalents thereof.

The invention claimed is:

1. A holster for securing a pistol having a barrel with a chamber, a muzzle, a slide having a front and rear portion with a front and rear sight situated thereon, wherein the holster comprises:

a shroud including a top wall, a left wall, and a right wall which define a pistol receiving space sized to partially receive the pistol therein, wherein the shroud defines a muzzle receiving space substantially near a front portion thereof, wherein the muzzle receiving space is sized to receive the muzzle and not allow the slide to enter therein; a connecting member extending between the left and right walls of the shroud;

a securing member movably attached to the connecting member and located within the shroud substantially near a rear portion thereof, wherein the securing member is shaped to receive a rear portion of the slide; and an actuating lever disposed externally to the shroud and attached via the connecting member to the securing member, wherein movement of the actuating lever causes the securing member to move between a first and second position, wherein the shroud is adapted to secure the pistol therein when the muzzle is inserted into the muzzle receiving space, the rear portion of the slide is secured within the securing member, and the securing member is positioned in the first position.

2. The holster of claim 1, wherein the shroud is a substantially walled open-bottom enclosure sized to substantially accommodate the slide therein.

3. The holster of claim 1, further comprising a protuberance extending from an interior surface of the shroud, wherein the protuberance is sized to be received into the chamber when the pistol is secured within the shroud.

4. The holster of claim 1, further comprising:

a first space defined within an upper interior surface of the shroud sized to receive the front sight; and a second space defined within the upper interior surface of the shroud sized to receive the rear sight.

5. The holster of claim 1, further comprising a groove defined along an outside surface of one of the sides of the shroud.

6. The holster of claim 1, wherein the connecting member further comprises a pin.

7. The holster of claim 6, wherein the securing member is connected in pivotal relation to the shroud.

8. The holster of claim 1, wherein the actuating lever is positioned in a substantially perpendicular relation to a side of the shroud.

9. The holster of claim 8, further comprising a protuberance attached above and in spaced relation to the actuating lever and extending from the shroud in a substantially perpendicular relation thereto, wherein the width of the protuberance is substantially equal or greater than the width of the actuating lever.

10. The holster of claim 1, further comprising a first and second hole defined in the rear portion of the shroud for accommodating a rod therethrough, whereby insertion of the rod prevents the movement of the securing member into the second position.

11. The holster of claim 10, further comprising a first and second hole defined in the front portion of the shroud for accommodating a rod therethrough, whereby insertion of the rod prevents the movement of the barrel in a forward direction.

12. The holster of claim 1, wherein the securing member is defined by a vertical member having substantially first and second horizontal members extending from respective ends of the vertical member and extending toward the front portion of the shroud.

13. The holster of claim 12, wherein the securing member is sized to correspondingly mate with at least a top, back, and bottom side of the rear portion of the slide.

14. The holster of claim 13, further comprising a spring disposed between an interior surface of the shroud and the securing member, wherein the spring provides a biasing force that causes the securing member to be maintained in the first position absent any external force applied to the actuating lever.

15. The holster of claim 1, further comprising a slot defined within one of the sides of the shroud for receiving fasteners for securing the holster to a wearable mount.

16. The holster of claim 15, wherein the wearable mount is a hip mount and the holster is mounted to the hip mount, wherein the hip mount comprises:

a first curved surface member having a first set of fastener holes defined therein;

a second curved surface member having a second set of fastener holes defined therein, wherein the location of the second set of fastener holes substantially corresponds to the location of the first set of fastener holes when the second curved surface member is correspondingly mated with the first curved surface member;

a first set of fasteners adapted to be received through the first set of fastener holes and be secured in the second set of fastener holes, wherein a space is provided between the first and second curved surface members to accommodate the belt therethrough;

a first plurality of mounting holes defined in at least the first curved surface member and aligned in a substantially vertical orientation thereon; and a second set of fasteners adapted to be received through the first plurality of mounting holes to secure the holster to the hip mount.

17. The holster of claim 16, wherein the hip mount further comprises a second plurality of mounting holes defined in the second curved surface member and substantially corresponding to the location of the first plurality of mounting holes of the first curved surface member when the second curved surface member is correspondingly mated with the first curved surface member.

18. The holster of claim 16, wherein the first set of fasteners are compression screws.

19. The holster of claim 16, wherein the second set of fasteners are corresponding nuts and bolts.

20. The holster of claim 19, wherein the nuts are adapted to be received adjacent the mounting slot of the holster to allow the corresponding bolts to threadably engage the nuts.

21. A holster for securing a pistol having a barrel with a chamber, a muzzle, a slide having a front and rear portion with a front and rear sight situated thereon, wherein the holster comprises:

a substantially walled open-bottom enclosure including a top wall, a left wall, and a right wall which define a slide receiving space sized to accommodate the slide therein, wherein a cavity defined in a front portion of the enclosure is sized to receive the muzzle and not allow the slide to enter therein; a connecting member extending between the left and right walls of the enclosure;

a securing member pivotally attached to the connecting member and located within the enclosure near a rear portion thereof, wherein the securing member is shaped to substantially correspondingly mate with a rear portion of the slide;

a lever disposed externally to the enclosure and attached via the connecting member to the securing member, wherein the connecting member includes a pin;

a spring disposed between an interior surface of the enclosure and the securing member; and a first protuberance extending from the interior surface of the enclosure, wherein the first protuberance is sized to be received into the chamber when the pistol is secured within the enclosure.

22. The holster of claim 21, further comprising a second protuberance attached above and in spaced relation to the lever and extending from the enclosure in a substantially perpendicular relation thereto, wherein the width of the second protuberance is substantially equal or greater than the width of the lever.

23. The holster of claim 21, further comprising:

a first space defined within the interior surface of the enclosure sized to receive the front sight; and a second space defined within the interior surface of the enclosure sized to receive the rear sight.

24. The holster of claim 21, further comprising a first and second hole defined in the rear portion of the enclosure for accommodating a rod therethrough.

* * * * *